US008733137B2

(12) United States Patent
Kim et al.

(10) Patent No.: US 8,733,137 B2
(45) Date of Patent: May 27, 2014

(54) WASHING MACHINE

(75) Inventors: Dongyoon Kim, Changwon-si (KR); Youngjong Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 575 days.

(21) Appl. No.: 12/850,917

(22) Filed: Aug. 5, 2010

(65) Prior Publication Data

US 2011/0030425 A1 Feb. 10, 2011

Related U.S. Application Data

(60) Provisional application No. 61/232,190, filed on Aug. 7, 2009.

(30) Foreign Application Priority Data

Dec. 4, 2009 (KR) ..... 10-2009-0119998

(51) Int. Cl.
*D06F 7/00* (2006.01)

(52) U.S. Cl.
USPC ..... 68/132

(58) Field of Classification Search
USPC ..... 68/3 R
See application file for complete search history.

(56) References Cited

U.S. PATENT DOCUMENTS

| | | | | |
|---|---|---|---|---|
| 7,392,672 | B2 | 7/2008 | Kim et al. | |
| 7,506,525 | B2 * | 3/2009 | La Belle et al. | 68/134 |
| 2003/0200774 | A1 * | 10/2003 | Kim et al. | 68/133 |

FOREIGN PATENT DOCUMENTS

| | | | |
|---|---|---|---|
| CN | 2898085 | Y | 5/2007 |
| CN | 201121261 | Y | 9/2008 |

* cited by examiner

*Primary Examiner* — Jason Ko
(74) *Attorney, Agent, or Firm* — Birch, Stewart, Kolasch & Birch, LLP

(57) ABSTRACT

Provided is a washing machine. The washing machine includes an outer tub, an inner tub, and a pulsator. The pulsator includes a base and a plurality of ribs. The ribs include an upper surface and a side surface. The upper surface extends from the hub to an outer side along a radial direction to meet a circumference of the base. The side surface declines from the upper surface to the base. The side surface includes a first side surface and a second side surface. The first side surface has a boundary with an inner side of the base. The boundary radially diverges outward in a circumference direction. The second side surface extends from the first side surface along the circumference of the base and the upper surface.

17 Claims, 10 Drawing Sheets

WASHING MACHINE

CROSS REFERENCE TO RELATED APPLICATIONS

This nonprovisional application claims the benefit of U.S. Provisional Application No. 61/232,190 filed on Aug. 7, 2009 and to Patent Application No. 10-2009-0119998 filed in Republic of Korea, on Dec. 4, 2009. The entire contents of all of the above applications are hereby incorporated by reference into the present application.

BACKGROUND

1. Field

The present invention relates to a washing machine, and more particularly, to a washing machine with better washing performance achieved through improving the circulating motion of laundry.

2. Description of the Related Art

In general, the term "washing machine" denotes any of various apparatuses that remove contaminants from laundry through chemical effects of detergent and physical action such as wash water turbulence.

A typical washing machine includes an outer tub in which wash water is filled, an inner tub that is rotatably provided within the outer tub to hold laundry, and a pulsator that rotates within the inner tub.

In such a typical washing machine, because wash water turbulence is generated in the direction of pulsator rotation, the movement of laundry is also induced in a horizontal circulating motion according to the direction of pulsator rotation, and a comparatively slight vertical circulating motion of laundry is generated within the inner tub.

Accordingly, washing of laundry is not performed three-dimensionally, laundry cannot uniformly contact the pulsator, and washing performance is compromised.

BRIEF SUMMARY OF THE INVENTION

Thus, an object of the present invention is to provide a washing machine having improved laundry performance by improving motion of the laundry.

According to an aspect of the present invention, there is provided a washing machine including: an outer tub holding wash water; an inner tub rotatably provided in the outer tub; and a pulsator rotatably provided in the inner tub, the pulsator including: a base including a hub formed at the center thereof; and a plurality of ribs protruding from the base, the plurality of ribs including: an upper surface extending from the hub to an outer side along a radius direction to meet a circumference of the base; and a side surface declining from the upper surface to the base, the side surface including: a first side surface having a boundary with an inner side of the base, the boundary outwardly radially diverging in a circumference direction; and a second side surface extending from the first side surface along the circumference of the base and the upper surface.

According to another aspect of the present invention, there is provided a washing machine including: an outer tub holding wash water; an inner tub rotatably provided in the outer tub; and a pulsator rotatably provided in the inner tub, the pulsator including: a first pulsator member formed of metal material; and a second pulsator member formed of plastic material, having a shape corresponding to the first pulsator member, coupled to a lower side of the first pulsator member, and rotated along with the first pulsator member, wherein the first pulsator member includes: a base having a hub formed at the center thereof; and a plurality of ribs protruding from the base, the plurality of ribs including: an upper surface extending from the hub to an outer side along a radius direction to meet a circumference of the base; and a side surface declining from the upper surface to the base, the side surface including: a first side surface having a boundary with an inner side of the base, the boundary outwardly radially diverging in a circumference direction; and a second side surface extending from the first side surface along the circumference of the base and the upper surface.

According to still another aspect of the present invention, there is provided a washing machine including: an outer tub holding wash water; an inner tub rotatably provided in the outer tub; and a pulsator rotatably provided in the inner tub, the pulsator including: a base including a hub formed at the center thereof; and a plurality of ribs protruding from the base, the plurality of ribs including: an upper surface extending from the hub to an outer side along a radius direction to meet a circumference of the base; and a side surface declining from the upper surface to the base, the side surface including: a first side surface outwardly radially diverging in a circumference direction such that a contact area with laundry is gradually broadened; and a second side surface forming a curved surface in a body along with the first surface and extending from the first side surface to meet the upper surface and the circumference of the base, in order to reduce flow resistance caused by the wash water in the inner tub.

The foregoing and other objects, features, aspects and advantages of the present invention will become more apparent from the following detailed description of the present invention when taken in conjunction with the accompanying drawings.

DETAILED DESCRIPTION

Figure 1:
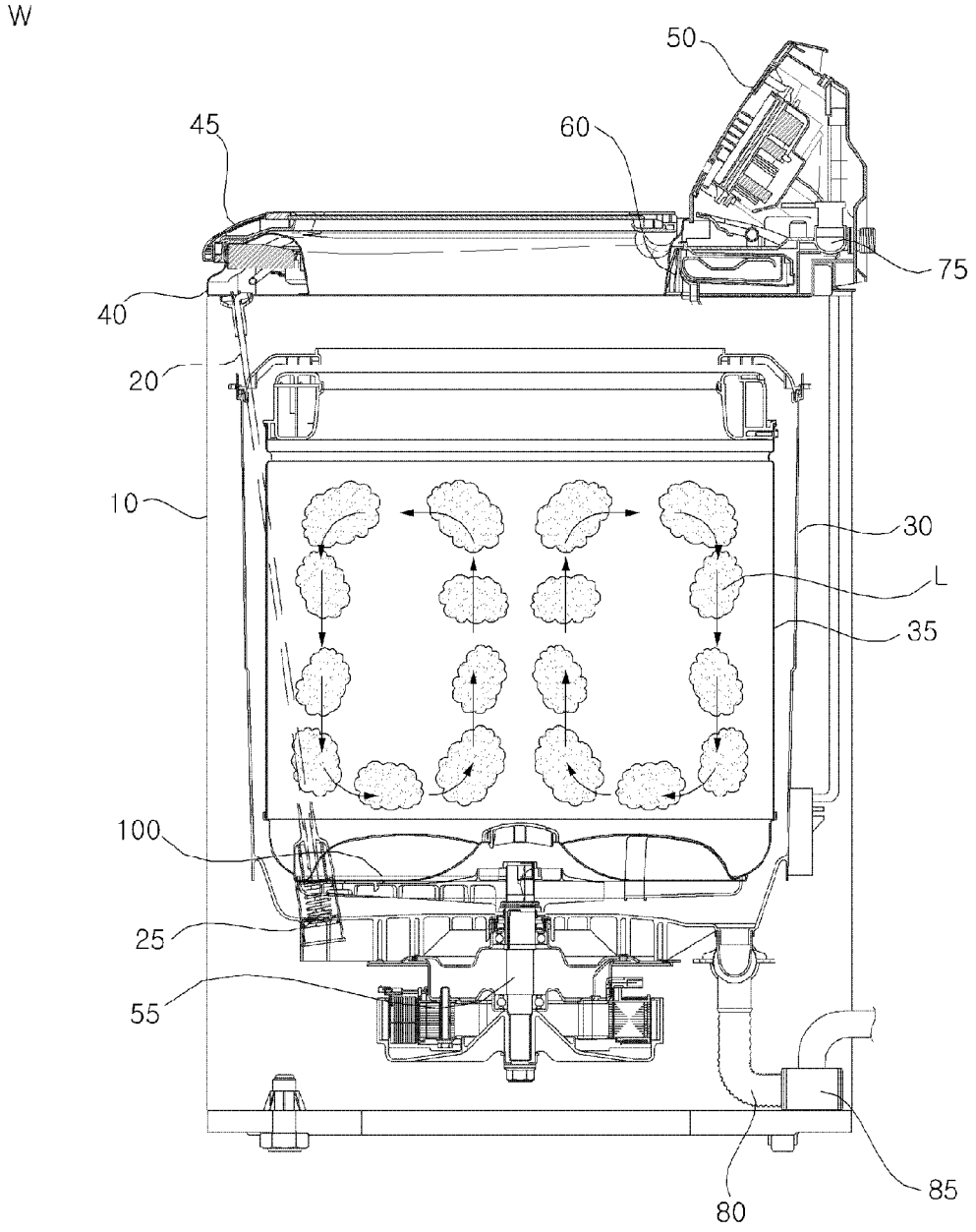
FIG. 1 is a lateral, cross-sectional view of a washing machine according to an embodiment of the present invention.

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Figure 2:
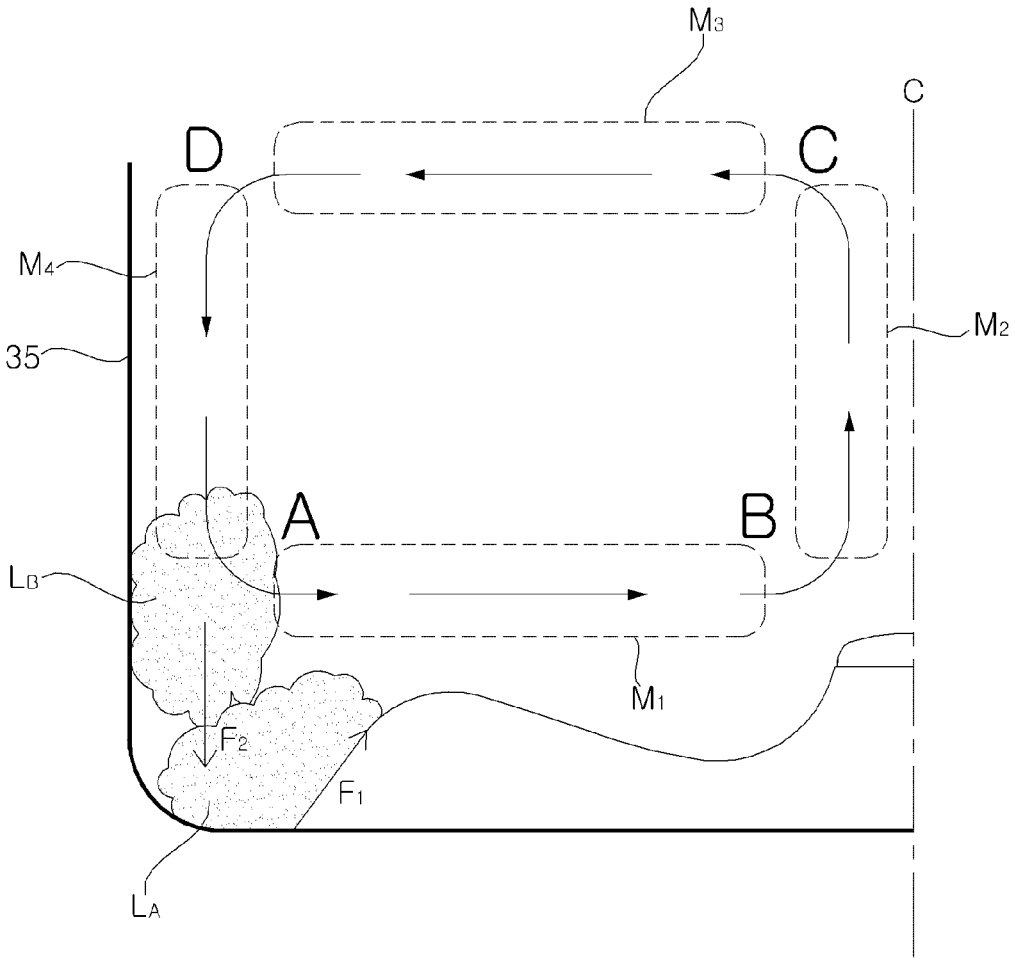
FIG. 2 is a view showing an inverse toroidal rollover motion of laundry within the inner tub of a washing machine according to an embodiment of the present invention.
Figure 3:
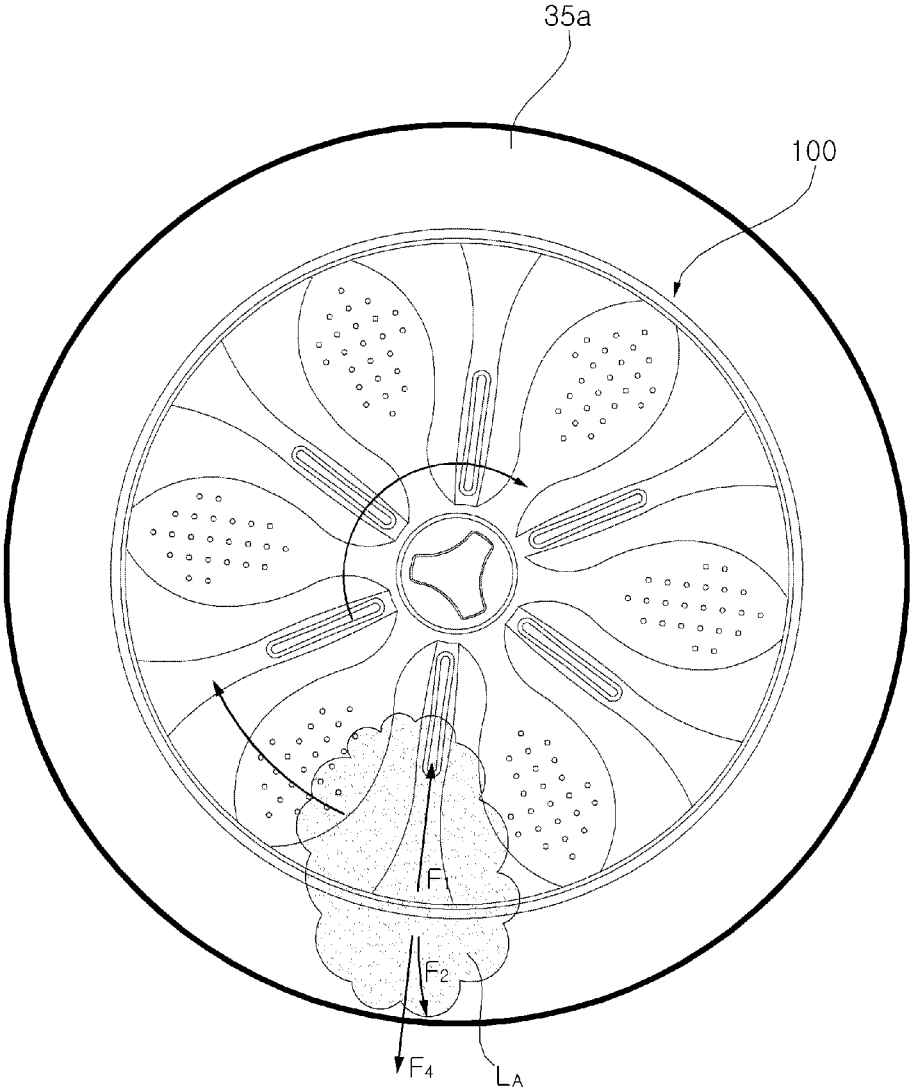
FIG. 3 is a view showing the forces imparted to laundry (LA) within an inner tub.

FIG. 1 is a lateral, cross-sectional view of a washing machine W according to an embodiment of the present invention. FIG. 2 illustrates an inverse toroidal rollover motion of the laundry generated in an inner tub of a washing machine W according to an embodiment of the present invention. FIG. 3 is a view showing the forces imparted to laundry LA within an inner tub.

Referring to FIG. 1, a washing machine W according to an embodiment of the present invention may include a cabinet 10, a top cover disposed over the cabinet 10 and having a laundry access opening through which laundry is loaded or unloaded, a door 45 coupled to the top cover 40 and rotated to open and close the laundry access opening, and a control panel providing a user interface such as an operation information display of the washing machine W.

An outer tub 30 suspended by a support member 20 may be provided in the cabinet 10. The support member 20 may be coupled to the outer tub 30 by a buffer member 25 to dampen vibration generated during washing.

Water supplied from an external water source may flow through a water supply valve 75, and may be supplied to the outer tub 30 via a detergent box 60. The detergent box 60 may hold laundry additives such as detergent, fabric softener, and/or bleaching agents. Laundry additives that are necessary for cycles such as a wash cycle, rinse cycle, and spin-dry cycle may be mixed with water to be supplied to the outer tub 30. Accordingly, water or water mixed with laundry additives may be supplied into the outer tub 30 during operation of the washing machine W. Hereinafter, the term referred to as 'wash water' may be defined as a concept that includes both water and water mixed with laundry additives.

The inner tub 35 may be rotatably provided in the outer tub 30. Wash water may flow between the outer tub 30 and the inner tub 35. A pulsator 100 may be rotatably provided on the bottom of the inner tub 35.

A driving unit 55, which is a device for rotating the inner tub 35 and/or the pulsator 100, may include a motor generating a rotary force and a clutch delivering the rotary force to selectively rotate the inner tub 35 and the pulsator 100. In this case, the pulsator 100 may be continuously rotated in one direction, and may also be alternately rotated in both directions. Hereinafter, alternate rotating of the pulsator 100 in both directions may be defined as 'agitating rotation'.

By rotating the pulsator 100 during a wash cycle, contamination of laundry may be efficiently removed by frictional interaction between the pulsator 100 and the laundry. In this case, the pulsator 100 may be alternately rotated to untangle tangled laundry in the inner tub 30.

The driving unit 55 may be divided into direct drive type and indirect drive type according to the mode of rotational force delivery from a motor. A direct drive type in which an inner tub and a pulsator are directly coupled about the same axis as the rotational axis of a motor is disclosed in the present embodiment, but embodiments are not limited thereto. For example, an indirect drive type in which the rotational force of the motor is delivered through a power transmission means such as a belt and pulley may be employed.

On the other hand, the washing machine W may further include a drain hose 80 and a drain pump 85 for discharging wash water from the outer tub 30.

Referring to FIG. 2, movement of the laundry in the inner tub 35 upon rotation of the pulsator 100 will be described below.

As the pulsator 100 rotates, the laundry L may be converged from the bottom edge A of the inner tub 35 to the center B of the inner tub 35 and rise C, and then the laundry L may be diverged to the top edge D and fall, which shows a motion of circulating up and down as shown in FIG. 1. In this case, since the circulation direction of the laundry L is opposite to the flow direction of the wash water diverged from the center B of the inner tub 35 to the edge A by a centrifugal force generated from the rotation of the pulsator 100, the motion of the laundry L that is derived from the rotation of the pulsator as shown in FIG. 1 may be defined as 'inverse toroidal rollover motion'.

The inverse toroidal rollover motion may be generated by various causes, two of which will be described below.

Hereinafter, one of the causes of the inverse toroidal rollover will be described in detail with reference to FIGS. 2 and 3.

Referring to FIGS. 2 and 3, the laundry LA located at the bottom of the inner tub 35 may receive a frictional force F1 toward the center of the inner tub 35 at the contact surface with the pulsator 100.

In this case, the magnitude of the frictional force F1 may be affected by the shape of the laundry LA and the pulsator 100, and the contact area between the pulsator 100 and the laundry LA. The pulsator 100 applied to the washing machine W according to an embodiment of the present invention may increase the frictional force F1 to improve laundry performance by friction, and facilitate the inverse toroidal rollover motion.

At a lower movement region M1 shown in FIG. 2, the laundry LA may move to the center of the inner tub 35 due to the frictional force F1 acting between the pulsator 100 and the laundry LA. In this case, main forces acting on the laundry LA at the lower movement region M1 may include a frictional force F1 acting between the pulsator 100 and the laundry LA, the weight F2 of the laundry LB, and a frictional force F3 acting between the laundry LA and the bottom surface 35A of the inner tub 35, and a centrifugal force F4 by the rotation of the pulsator 100. Considering directions of the forces shown in FIGS. 2 and 3, it is necessary to increase the magnitude of the frictional force F1 acting between the pulsator 100 and the laundry in order to improve the inverse toroidal rollover motion.

Empty space generated by the convergence of the laundry LA to the center of the inner tub 35 along the lower movement region M1 may be occupied by the laundry LB. Accordingly, the laundry may be continuously converged to the center of the inner tub 35.

The laundry converged to the center of the inner tub 35 may rise at an ascending region M2, and may move from the center of the inner tub 35 to the edge of the inner tub 35 at a upper movement region M3. Thereafter, the laundry may fall along a descending region M4. Due to the above laundry circulation cycle, the inverse toroidal rollover motion may be completed.

Figure 4:
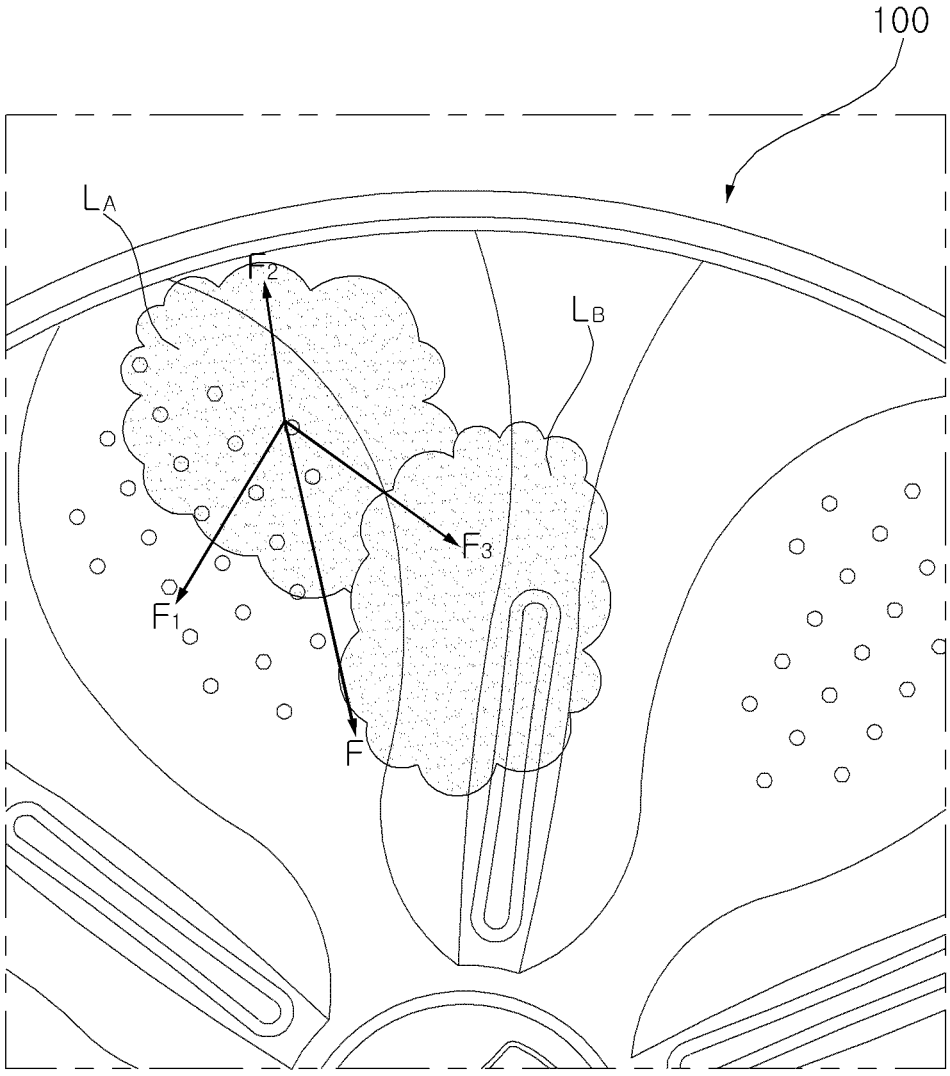
FIG. 4 is an enlarged view of a portion of a pulsator, showing other forces that generate an inverse toroidal rollover motion.

FIG. 4 is an enlarged view of a portion of a pulsator, showing other forces that generate an inverse toroidal rollover motion. Hereinafter, the reason why the inverse toroidal rollover motion is generated will be described from another aspect with reference to FIG. 4.

Referring to FIG. 4, forces acting on the laundry LA may include a frictional force F1 generated between the laundry LA and the pulsator 100, a centrifugal force F2 generated by the rotation of the pulsator 100, and a constraint force F3 by interference of the adjacent laundry LB.

The magnitude and direction of a resultant force F of the forces F1, F2, and F3 may vary according to the magnitudes and directions of the respective forces, while the force F may be oriented toward the center of the inner tub 35 under certain conditions.

Particularly, since the frictional force F1 faces the center of the inner tub 35 in comparison with the centrifugal force F2, it is important to increase the frictional force F1 between the laundry LA and the pulsator 100 similarly to the first reason described above, in order to allow the laundry LA to be converged to the center of the inner tub 35 and facilitate the inverse toroidal rollover motion.

Figure 5A:
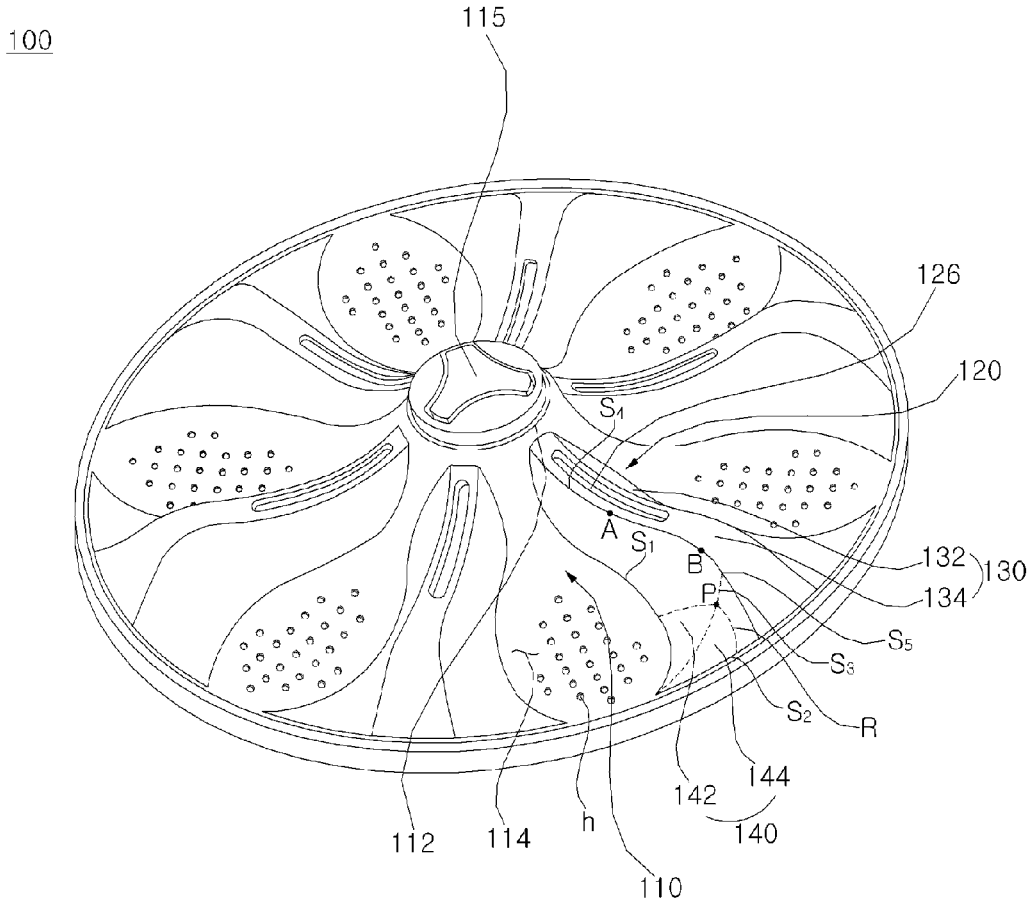
FIG. 5A is an embodiment of a pulsator applied to a washing machine according to an embodiment of the present invention.
Figure 5B:
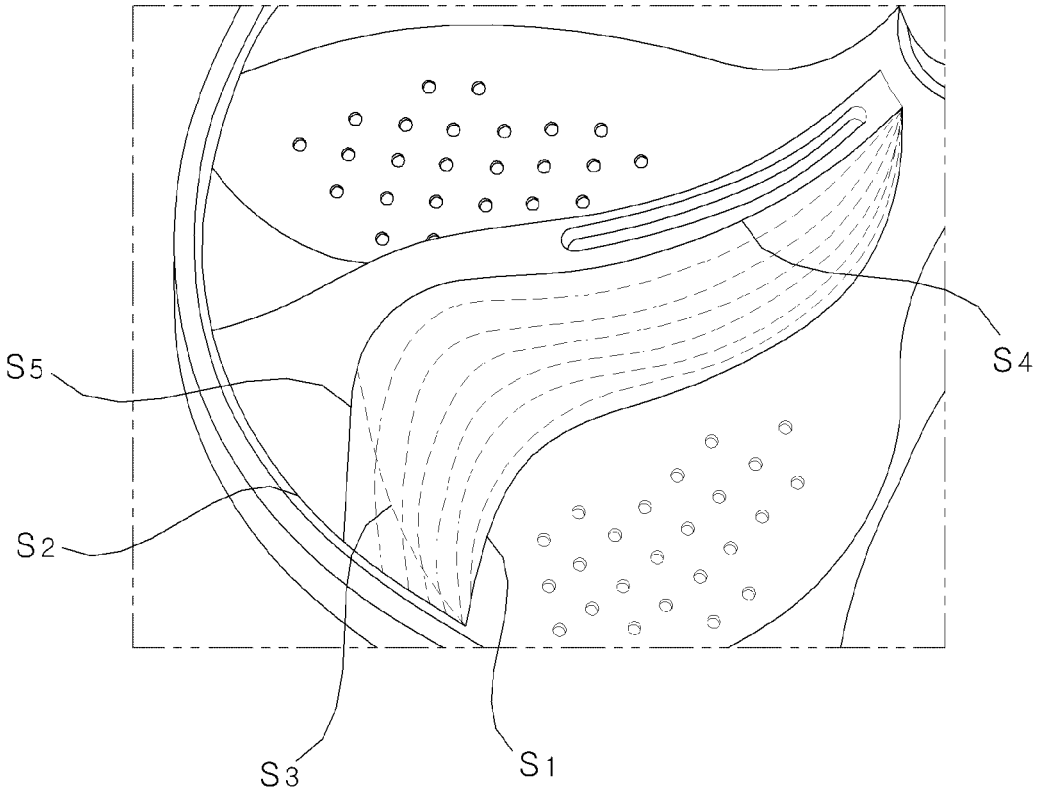
FIG. 5B is an enlarged view of a portion of the pulsator in FIG. 5A.
Figure 6:
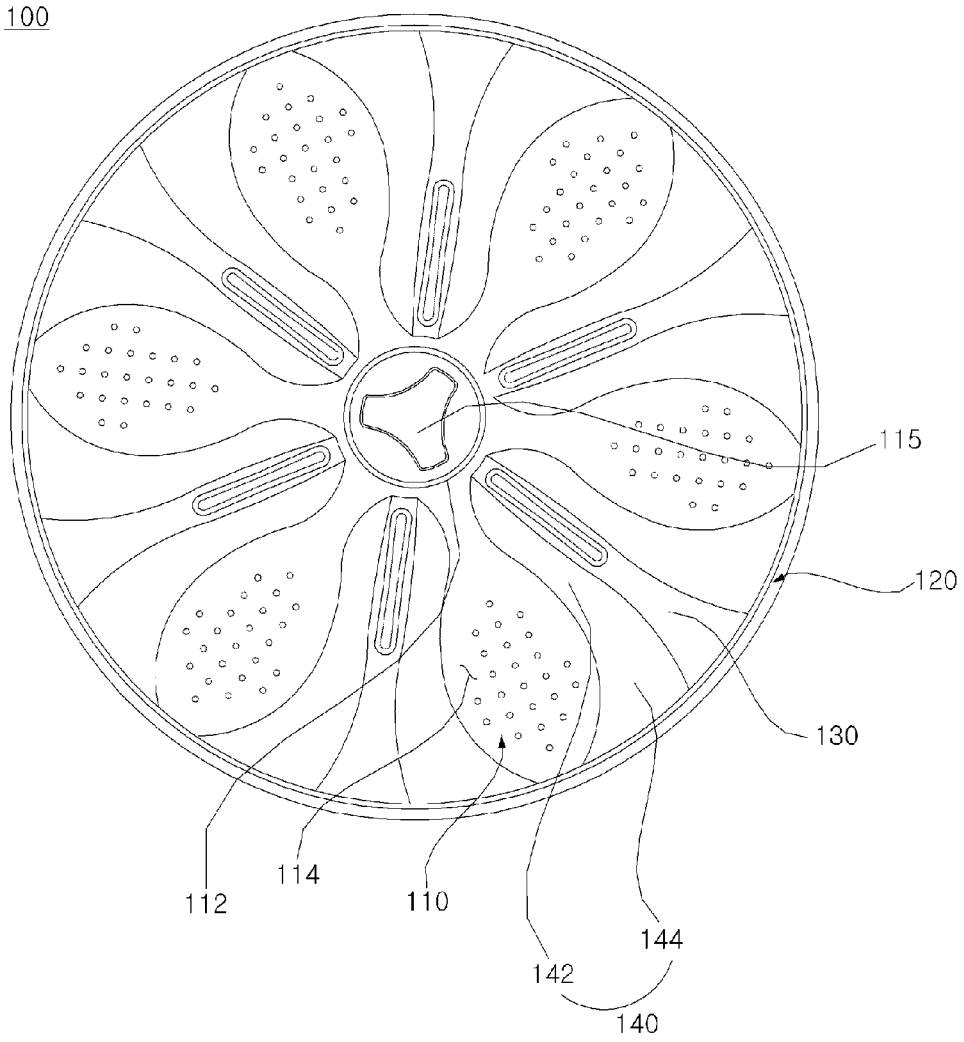
FIG. 6 is a plan view of the pulsator in FIG. 5A.
Figure 7:
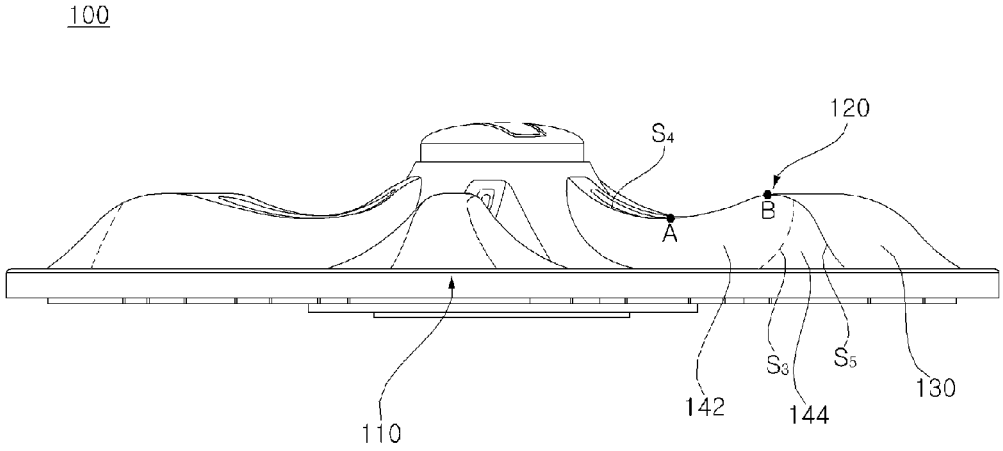
FIG. 7 is a lateral view of the pulsator in FIG. 5A.
Figure 8:
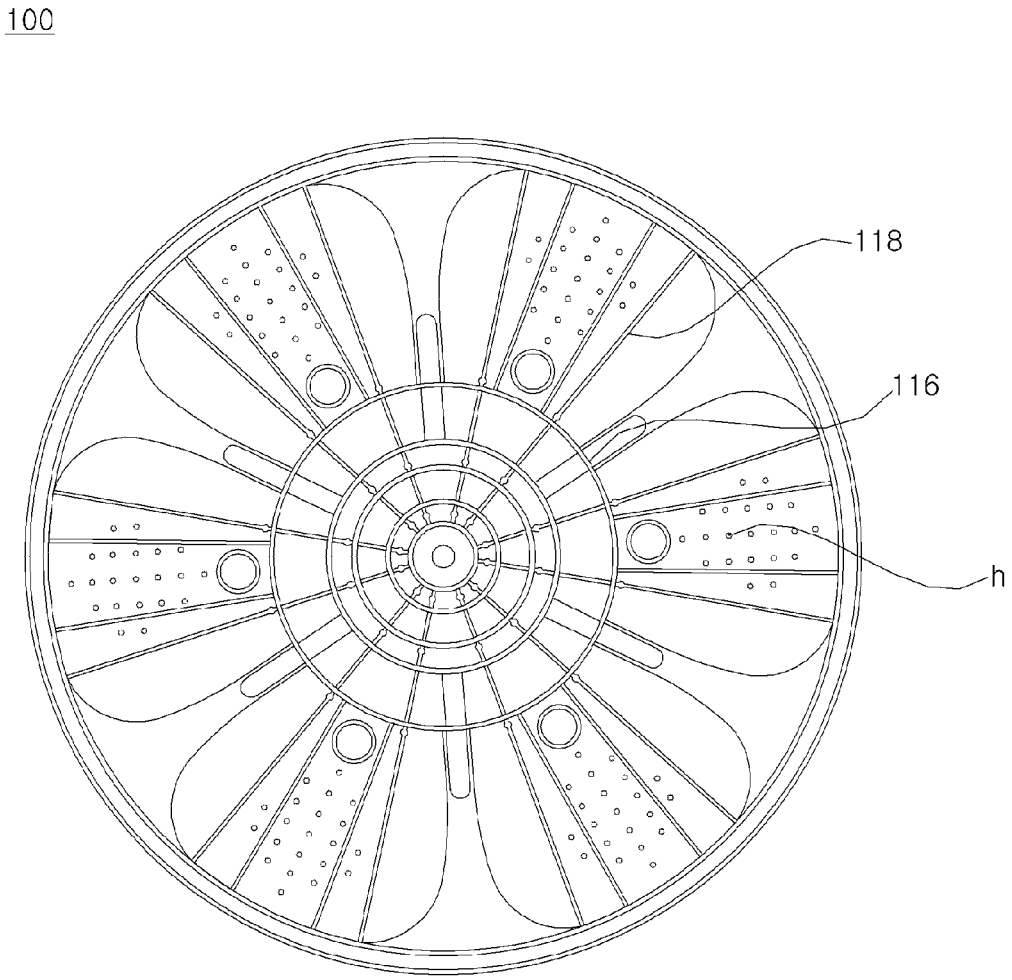
FIG. 8 is a bottom view of the pulsator in FIG. 5A.

FIG. 5A is an embodiment of a pulsator applied to a washing machine according to an embodiment of the present invention. FIG. 5B is an enlarged view of a portion of the pulsator in FIG. 5A. FIG. 6 is a plan view of the pulsator in FIG. 5A. FIG. 7 is a lateral view of the pulsator in FIG. 5A. FIG. 8 is a bottom view of the pulsator in FIG. 5A. Referring to FIGS. 5 through 8, a pulsator 100 may include a base having a hub 112 formed at the center thereof to be connected to a rotational axis of a driving unit 55, and a plurality of ribs 120 protruding from the base 110. A cap 115 may be disposed on the hub 112 to cover the internal structure.

The rib 120 may include an upper surface 130 extending from the hub 112 of the base 110 to an outer side along a radial direction to meet the circumference of the base 110, and a side surface 140 inclining from the upper surface 130 to the base 110.

The side surface 140 may include a first side surface 142 diverging in a circumferential direction as a boundary between the side surface and an inner side of the base 110 becomes closer to the outer side along the radial direction, and a second side surface 144 extending from the first side surface 142 along the circumference of the base 110 and the upper surface 130.

A first boundary S1 between the first side surface 142 and the base 110 may be diverged in the circumferential direction as the first boundary S1 becomes closer to the outer side along the radial direction of an inner side of the base 110, and the second side surface 144 and an outer circumference of the base 110 may form a second boundary S2.

The side surface 140 may be formed in a body in which the first side surface 142 and the second side surface 144 form a continuously curved surface. Accordingly, fluid resistance caused by wash water in a drum 35 can be efficiently reduced. In this case, the width of the side surface 140 may be gradually broadened as the side surface 140 becomes closer to the outer side along the radial direction. Accordingly, a contact area with the laundry may be gradually broadened as it becomes closer to the outer side along the radial direction.

More specifically, the first side surface 142 and the second side surface 144 may form a gently curved surface. A indication line R may be shown to describe a connection relation between the first side surface 142 and the second side surface 144. An inclination direction may be changed based on a point P crossing a line S3, in which slope is continuously changed from the first side surface 142 to the second side surface 144. That is, the line S3 may be obtained by linking points about which the inclination direction may be changed on an indication line R when the indication line R from the first side surface 142 to the second side surface 144 is randomly taken.

Based on the line S3, the first side surface 142 may decline to the base 110 to meet the base 110 at a first boundary line S1, and the second side surface 144 may decline to the circumference of the base 110 to meet the circumference of the base 110 at a second boundary line S2. In this case, the slope of the first side surface may be steeper than the second side surface 144.

The upper surface 130 may be formed to have a curved surface. As the upper surface 130 becomes closer to the outer side from the hub 112 along the radial direction, the upper surface 130 may have a first curved surface 132 that is recessed toward the base 110 and a second curved surface extending from the first curved surface and convexly protruding.

Curves S4 and S5 between the upper surface 130 and the side surface 140 may include a lowest point A and a highest point B. In this case, the lowest point A may be located between the hub 112 and the highest point B, and the highest point B may be located between the lowest point A and the circumference of the base 110. More specifically, the lowest point A where a distance between the upper surface 130 and the base 110 becomes minimal may be located on the first curve S4 between the first curved surface 132 and the side surface 140, and the highest point B where the distance between the upper surface 130 and the base 110 becomes maximal may be located on the second curve S5 between the second curved surface 134 and the side surface 140. In this case, the first curved surface 132 may be extended from the hub 112 such that the highest point B is located between the lowest point A and the circumference of the base 100, and the second curved surface 134 may be extended from the first curved surface 132 to meet the circumference of the base 110. In the curves S4 and S5, a distance from the lowest point A to the highest point B may be greater than a distance from the highest point B to the circumference of the base 110. Also, the curves S4 and S5 may be formed such that the highest point B is located closer to the circumference of the base 110 than the hub.

Through the above characteristics, the effects of increasing frictional force between the pulsator 100 and laundry, and strengthening the inverse toroidal rollover motion may be attained.

The upper surface 130 is formed to progressively increase in width radially outward, so that it has a progressively greater contact area with laundry along the outward radial direction. In accordance, the area of the side surface 130 per unit length progressively increases along the radially outward direction, and the centrifugal force that becomes progressively stronger toward the outer periphery of the pulsator 100 is offset to ensure that sufficient frictional force is provided between laundry and the pulsator 100 so that an inverse toroidal rollover motion can easily be attained.

The base 110 further includes a convergent portion 114 formed concaved between the wing portions 120. The convergent portion 114 defines a plurality of holes (h) communicating the inner tub 35 and the outer tub 30 to allow discharging of wash water from inside the inner tub 35 to the outer tub 30. The concave-shaped convergent portion 114 ensures that there is sufficient frictional surface area provided between the base 110 and laundry, and also enforces the tendency of laundry to converge radially toward the hub 112 by means of a pressure difference generated when wash water is discharged from within the inner tub 35 through the plurality of holes (h).

The upper surface 130 is formed to become progressively wider in width from the center of the pulsator 100 in a radial direction outward. Thus, a sufficient amount of contacting area may be secured between the pulsator 100 and laundry, even at the outer periphery of the pulsator 100 where the exerted centrifugal force is greatest, thereby improving washing performance through the application of friction between the pulsator 100 and laundry, as well as ensuring the formation of an inverse toroidal rollover motion.

Provided on the undersurface of the pulsator 110 to reinforce the strength of the pulsator 100 are a plurality of annular ribs 116 arranged concentrically about the hub 112, and radial ribs 118 formed radially around the hub 112 to intersect with the annular ribs 116.

Figure 9:
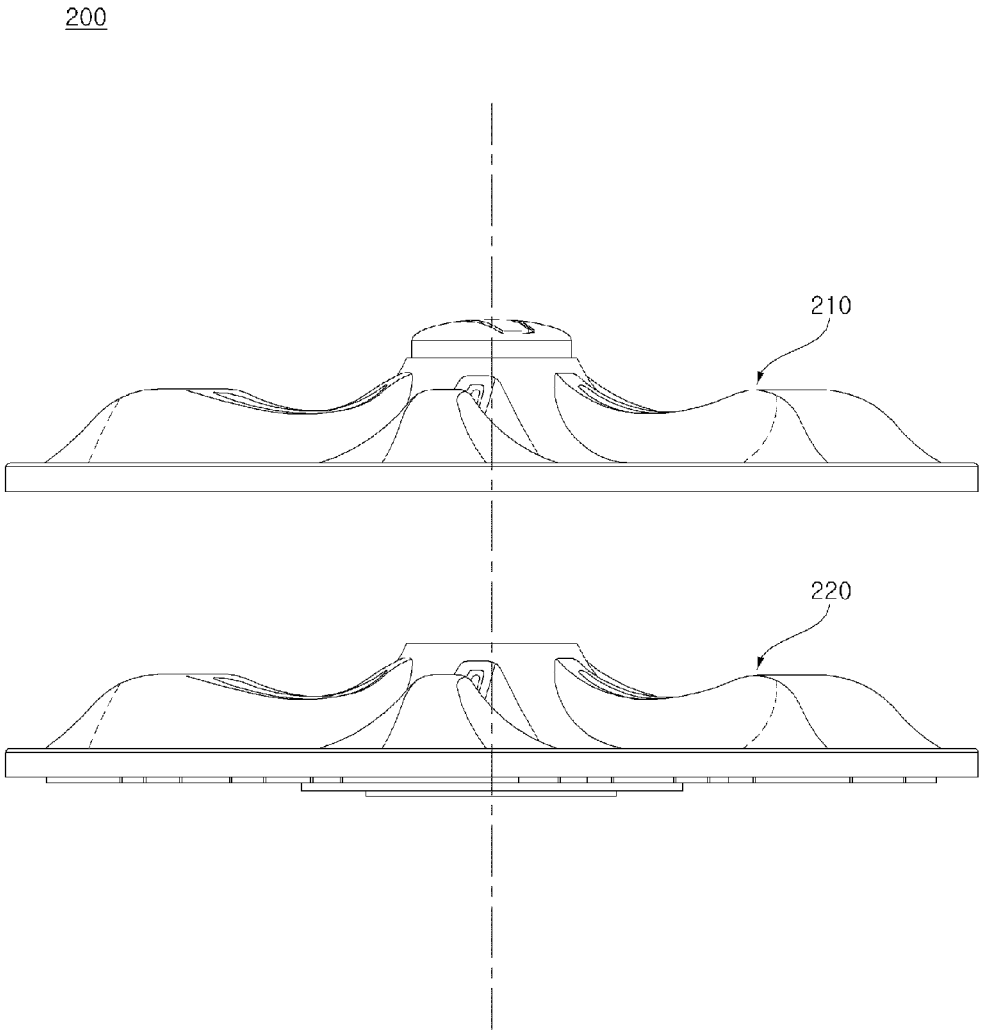
FIG. 9 is another embodiment of a pulsator applied to the washing machine according to an embodiment of the present invention.

FIG. 9 is another embodiment of a pulsator applied to the washing machine according to an embodiment of the present invention.

Below, description of configurations that are the same or similar to the pulsator 100 according to the embodiment described above will not be provided.

Referring to FIG. 9, a pulsator 200 includes a first pulsator member 210, and a second pulsator member 220 formed in a shape corresponding to the first pulsator member 210 and coupled at the bottom of the first pulsator member 210 to rotate integrally with the first pulsator member 210.

The first pulsator member 210 includes a base with a hub formed in the middle, and a plurality of wing portions projecting from the base.

The wing portion includes an upper surface extending outward in a radial direction from the hub to the outer periphery of the base, and side surfaces formed sloping toward the base from the upper surface.

The side surface includes a first side surface formed such that the boundary of its slope with the inner side of the base diverges outward in a circumferential direction progressively in a radially outward direction, and a second side surface extending from the upper surface and along the outer periphery of the base.

Here, the first pulsator member 210 is formed of metal material, and the second pulsator member 220 is formed of plastic material. Accordingly, the pulsator 200 imparts a visual perception of quality to a user by means of the upper surface formed of the metal first pulsator member 210, and can reduce the amount of metal used by means of the plastic second pulsator member 220 that is not seen by the user.

The first pulsator member 210 and the second pulsator member 220 are substantially the same in terms of configuration as the pulsator 100 according to the embodiment described previously, and thus, further description will not be provided.

A washing machine according to the present invention improves the circulating motion of laundry within the inner tub to achieve the effect of better washing performance.

Also, a washing machine according to the present invention has the benefit of being capable of three-dimensional washing of laundry within the inner tub in an inverse toroidal rollover motion.

Additionally, a washing machine according to the present invention has the effect of a strong inverse toroidal rollover motion of laundry, formed through increased surface area for friction between a pulsator and the laundry.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing machine comprising:
an outer tub holding wash water;
an inner tub rotatably provided in the outer tub; and
a pulsator rotatably provided in the inner tub, the pulsator comprising:
a base comprising a hub formed at a center thereof; and
a plurality of ribs protruding from the base, each rib comprising:
an upper surface extending outwardly along a radial direction to meet an outer circumference of the base; and
a side surface declining from the upper surface to the base, the side surface comprising:
a first side surface having a boundary with the base, the boundary radially diverging outward in a circumference direction, the boundary meeting an inner circumference of the base; and
a second side surface extending from the first side surface to meet the outer circumference of the base and the upper surface,
wherein the first side surface is formed integrally with the second side surface to form a continuously curved surface, and
wherein the first and second side surfaces progressively broaden in an outward radial direction.

2. The washing machine of claim 1, wherein the first side surface declines to the base more steeply than the second side surface.

3. The washing machine of claim 1, wherein the upper surface is curved.

4. The washing machine of claim 3, wherein as the upper surface extends outwardly in the radial direction, a first curved surface that is recessed toward the base and a second curved surface extending from the first curved surface to meet the outer circumference of the base and convexly protruding are formed continuously from the upper surface, and
wherein the first and second curved surfaces progressively broaden in an outward radial direction.

5. The washing machine of claim 4, wherein a lowest point where a distance between the upper surface and the base becomes minimal is formed on a first curve that the first curved surface and the side surface form, a highest point where the distance between the upper surface and the base becomes maximal is formed on a second curve that the second curved surface and the side surface form, and the first curved surface is extended from the hub such that the highest point is located between the lowest point and the outer circumference of the base, and the second curved surface is extended from the first curved surface to meet the outer circumference of the base.

6. The washing machine of claim 5, wherein a distance from the lowest point to the highest point is greater than a distance from the highest point to the outer circumference of the base.

7. The washing machine of claim 5, wherein the highest point is located closer to the outer circumference of the base than the hub.

8. The washing machine of claim 5, wherein the first side surface and the second side surface have different inclination directions about a boundary between the first side surface and the second side surface.

9. The washing machine of claim 4, wherein the base comprises a convergent portion that is recessed between adjacent ribs from among the plurality of ribs.

10. The washing machine of claim 9, wherein the convergent portion defines a plurality of holes that communicate the inner tub and the outer tub.

11. The washing machine of claim 4, wherein the upper surface progressively broadens in an outward radial direction to meet the outer circumference of the base.

12. The washing machine of claim 1, wherein the side surface is formed at both sides of the upper surface.

13. A washing machine comprising:

an outer tub holding wash water;

an inner tub rotatably provided in the outer tub; and a pulsator rotatably provided in the inner tub, the pulsator comprising:

a base comprising a hub formed at the center thereof; and a plurality of ribs protruding from the base, each rib comprising:

an upper surface extending outwardly along a radial direction to meet an outer circumference of the base; and a side surface declining from the upper surface to the base, the side surface comprising:

a first side surface extending radially and diverging outwardly in a circumference direction such that a contact area with laundry is gradually broadened; and a second side surface forming a curved surface in a body along with the first side surface and extending from the first side surface to meet the upper surface and the outer circumference of the base, in order to reduce flow resistance caused by the wash water in the inner tub, wherein a boundary between the first side surface and the base meets an inner circumference of the base, wherein the first side surface is formed integrally with the second side surface to form a continuously curved surface, and wherein the first and second side surfaces progressively broaden in an outward radial direction.

14. The washing machine of claim 13, wherein the first side surface declines to the base more steeply than the second side surface.

15. The washing machine of claim 13, wherein the first side surface and the second side surface have different inclination directions about a boundary between the first side surface and the second side surface.

16. The washing machine of claim 13, wherein the side surface is gradually broadened toward the outer side along the radial direction to meet the outer circumference of the base.

17. The washing machine of claim 13, wherein the base comprises a convergent portion that is recessed between adjacent ribs from among the plurality of ribs.

* * * * *